US005600298A

United States Patent [19]

Masuda

[11] Patent Number: 5,600,298

[45] Date of Patent: Feb. 4, 1997

[54] VARIABLE RESISTOR

[75] Inventor: Fumitoshi Masuda, Kyoto, Japan

[73] Assignee: Murata Manufacturing Co., Ltd., Japan

[21] Appl. No.: 288,686

[22] Filed: Aug. 11, 1994

[30] Foreign Application Priority Data

Aug. 19, 1993 [JP] Japan ..... 5-228068

[51] Int. Cl.[6] ..... H01C 10/32

[52] U.S. Cl. ..... 338/162; 338/176

[58] Field of Search ..... 338/118, 125, 338/127, 160, 161, 162, 176

[56] References Cited

U.S. PATENT DOCUMENTS

| | | | |
|---|---|---|---|
| 3,683,308 | 8/1972 | Hamill | 338/162 |
| 4,427,966 | 1/1984 | Gratzinger et al. | 338/162 |
| 4,646,055 | 2/1987 | Watanabe et al. | 338/162 |
| 5,047,746 | 9/1991 | Stilwell et al. | 338/162 |

*Primary Examiner*—Tu B. Hoang

*Attorney, Agent, or Firm*—Ostrolenk, Faber, Gerb & Soffen, LLP

[57] ABSTRACT

A wiper and a rotor are held to be rotatable with respect to a substrate which is provided on its one major surface with an arcuately extending resistive element. A contact member sliding along the resistive element is formed by bending a portion integrally extending from a wiper body. The wiper is integrally provided with a detent member, which is so formed as to bridge two points of a peripheral edge portion of the wiper body. The detent member engages with the rotor, thereby providing a clutch mechanism for stably transmitting rotation of the rotor to the wiper for rotating the rotor and the wiper along with each other until the wiper is inhibited from the rotation.

19 Claims, 4 Drawing Sheets

VARIABLE RESISTOR

BACKGROUND OF THE INVENTION

1. Field of the Invention

The present invention relates to a variable resistor comprising a contact member which slides along an arcuate resistive element, and more particularly, it relates to a variable resistor which comprises a clutch mechanism for transmitting rotation to a wiper forming the contact member.

2. Description of the Background Art

For example, U.S. Pat. No. 5,047,746 granted to Stilwell et al. describes a variable resistor.

The variable resistor (potentiometer) disclosed in the above U.S. Patent comprises an electrically insulating substrate, a resistive element arcustely extending on its one major surface, and a wiper which is affixed opposite the major surface of the substrate and rotatable with respect to the substrate.

A clutch mechanism enables the rotor to rotate the wiper so that a contact member formed on the wiper slides along the resistive element when the wiper rotates. As, a result value which is provided by this variable resistor is adjusted.

In the aforementioned variable resistor, the clutch mechanism is provided by a plurality of grooves which are formed at regular intervals and radially extend on the rotor, and a detent finger which is formed to integrally extend from the wiper. The detent finger has a free end which is engageable with any one of the grooves which are formed on the rotor.

However, the aforementioned detent finger is cantilevered with respect to the wiper. As a result the clutch action may be varied with the direction of the rotation which is transmitted from the rotor to the wiper, leading to inferior reliability of the clutch action.

Further, the contact member is provided in the aforementioned variable resistor by mounting a plurality of wires on a spring arm integrally extending from the wiper. Thus, the contact member is complicated in structure, and requires extensive efforts to obtain such a contact member. Consequently, the manufacturing cost for the variable resistor is disadvantageously high.

SUMMARY OF THE INVENTION

Accordingly, an object of the present invention is to provide a variable resistor which can solve the aforementioned problems.

The present invention is directed to a variable resistor comprising an electrically insulating substrate, a conductive collector and a resistive element, arcuately extending around the collector, which are formed on one major surface of the substrate, In addition, the invention further comprises a wiper of a metal plate having springiness which is arranged opposite the major surface of the substrate and held to be rotatable with respect to the substrate, a rotor which is arranged opposite the major surface of the substrate and held to be rotatable with respect to the substrate and the wiper, and a clutch mechanism which enables the rotor to rotate the wiper for to a place where the wiper is inhibited from further rotation.

In order to solve the aforementioned technical problems, the following structure is employed in the present invention:

The wiper includes a wiper body, and a contact member which is formed by bending a portion which extends integrally from the wiper body. While the contact member slides along the resistive element due to rotation of the wiper, while electrical contact is created between the collector and a selected position on the resistive element.

Further, the clutch mechanism comprises a detent member, which integrally extends from the wiper body along its peripheral edge portion while bridging two points of the peripheral edge portion. The detent member and the rotor have first and second engaging portions which are elastically engageable with each other respectively.

According to the present invention, the detent member and the contact member can be formed intergrally by the metal plate which makes up the wiper. Therefore, it is possible to form the contact member by simply thereby reducing the manufacturing cost for the variable resistor.

Further, both ends of the detent member are coupled to the wiper body, whereby the detent member can be deflected in a well-balanced manner regardless of the direction of the rotation transmitted from the rotor to the wiper. Thus, it is possible to apply a stable clutch action with great reliability. In addition, it is possible to prevent the detent member from having its free end entangled with other components while assembling the variable resistor, thereby improving the efficiency of its assembly.

According to the present invention, the contact member preferably comprises a plurality of fingers which are divided from each other through a cut or shearing. Thus, it is possible to improve reliability in contact between the contact member and each of the resistive element and the collector, thereby obtaining a highly reliable variable resistor.

According to the present invention, further, the detent member is preferably so angled with respect to the wiper body so that the first engaging portion provided therein further strongly elastically engages in a strong fashion, with the second engaging portion provided in the rotor. Thus, it is possible to improve reliability in transmission of rotation from the rotor to the wiper.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
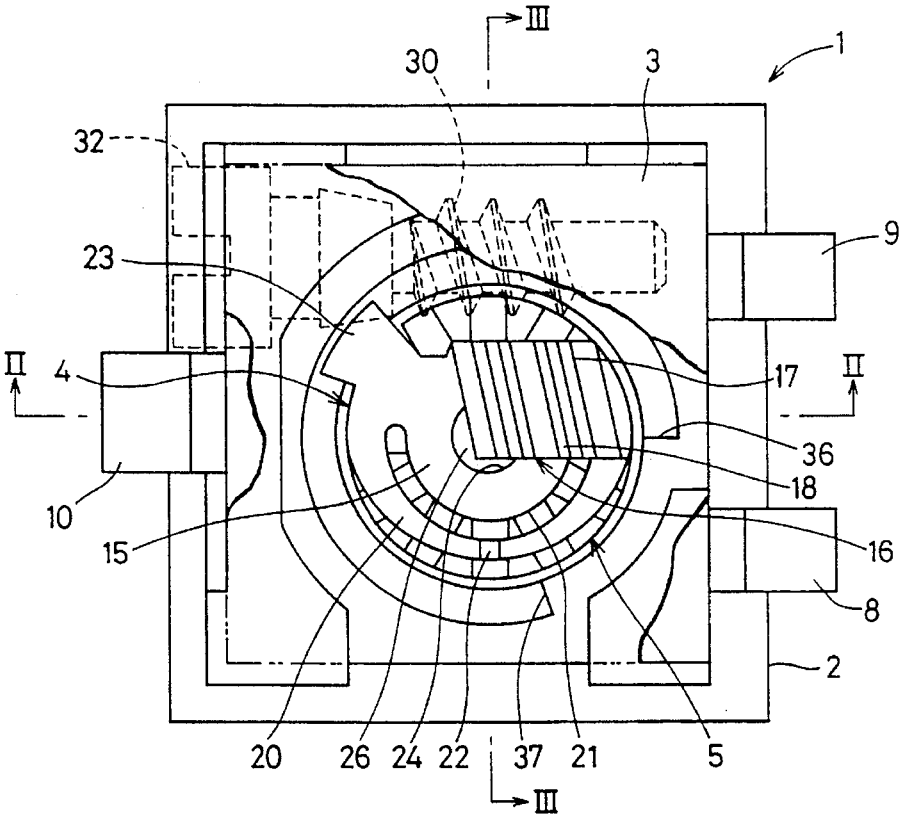
FIG. 1 is a plan view showing a variable resistor according to an embodiment of the present invention.
Figure 2:
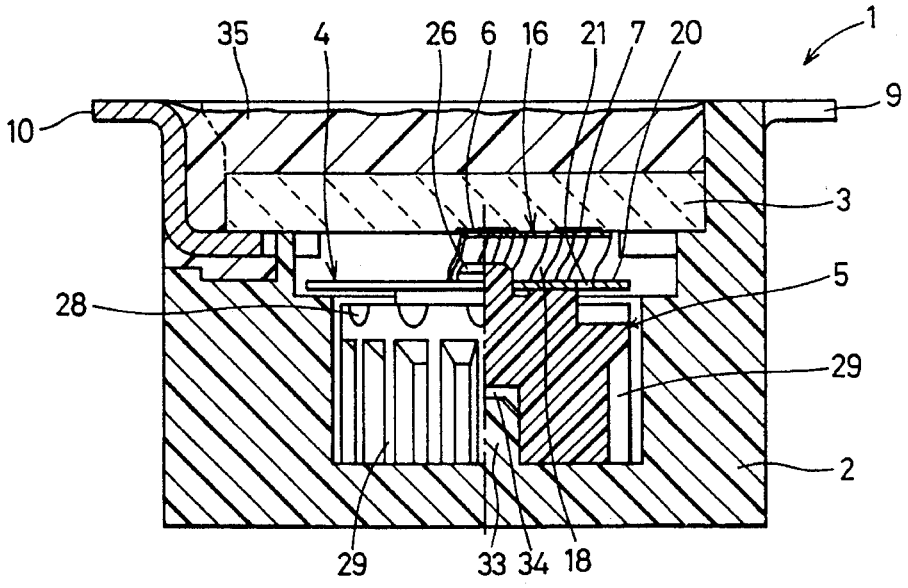
FIG. 2 is a sectional view taken along the line II—II in FIG. 1.
Figure 3:
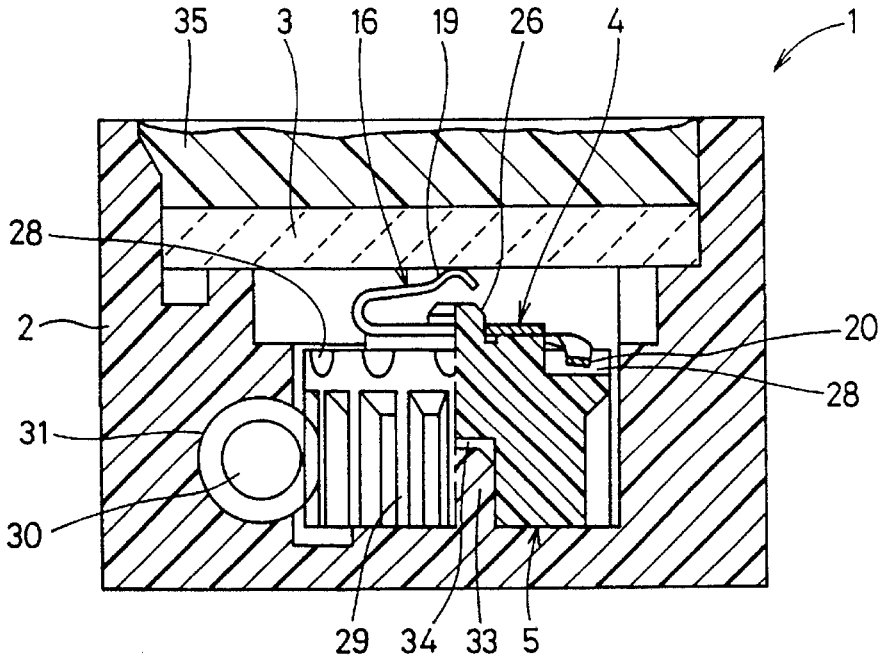
FIG. 3 is a sectional view taken along the line III—III in FIG. 1.

Referring to FIGS. 1, 2 and 3, a variable resistor 1 comprises a housing 2 which is made of an electrically insulating material such as resin, for example, and a substrate 3, a wiper 4 and a rotor 5 are enclosed in this housing 2.

The substrate 3 is made of an electrically insulating material. This electrically insulating material is prepared from a ceramic such as alumina, for example. As clearly understood from FIG. 4, the substrate 3 is provided on its one major surface with a conductive collector 6 and a resistive element 7 arcuately extending around this collector 6. The resistive element 7 is provided by a film which is formed by applying electric resistive paste and baking the same, for example.

Figure 4:
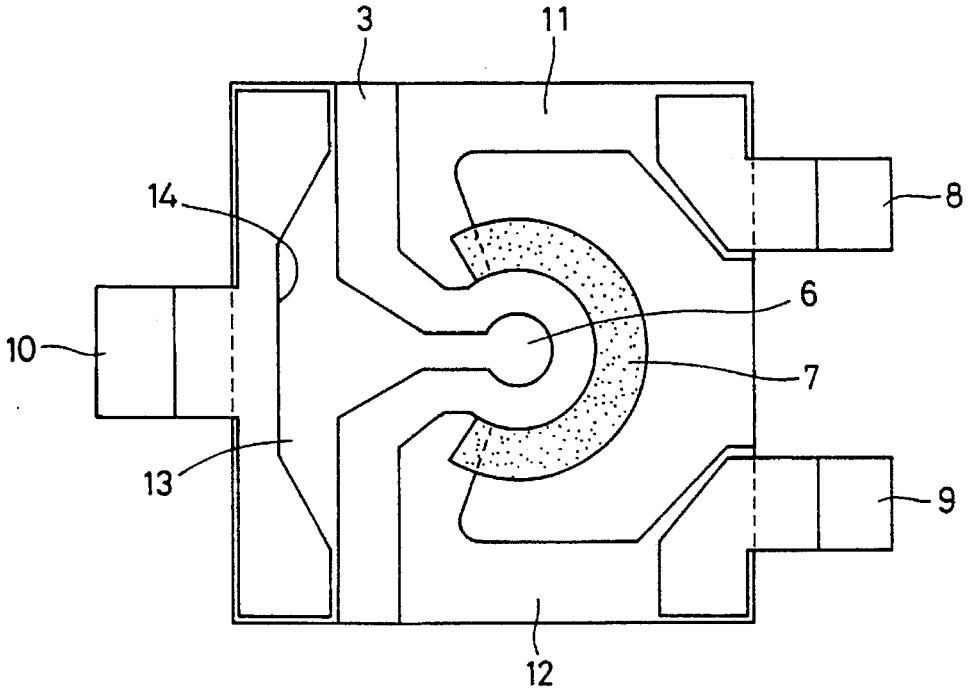
FIG. 4 is a bottom plan view of a substrate provided in the variable resistor shown in FIG. 1.

Referring to FIG 4. the substrate 3 holds first, second and third terminals 8, 9 and 10. The first and second terminals 8 and 9 are electrically connected to respective end portions of the resistive element 7 through conductor films 11 and 12 respectively. The third terminal 10 is electrically connected to a conductor film 13 which integrally extends from the collector 6. When the substrate 3 is stored in the housing 2, the terminals 8 to 10 partially project from the housing 2 respectively, as shown in FIGS. 1 and 2. The portions of the terminals 8 to 10 projecting from the housing 2 extend substantially flush with one end surface of the housing 2, thereby making the variable resistor 1 surface-mountable. When the variable resistor 1 is surface-mounted on a circuit board (not shown), the surface of the housing 2 shown in FIG. 1, i.e., which is upwardly directed in FIGS. 2 and 3, is directed to the circuit board.

As shown in FIG. 4, the third terminal 10 is T-shaped as a whole, and is provided with a notch 14 adjacent to a longitudinal center of a portion of the T-shaped terminal located on the substrate Referring again to FIG. 1 or 2 and 3, due to formation of such a notch 14, it is possible to further increase the space of the housing 2 for storing the wiper 4 and the rotor 5, thereby miniaturizing the overall variable resistor 1.

Figure 5A:
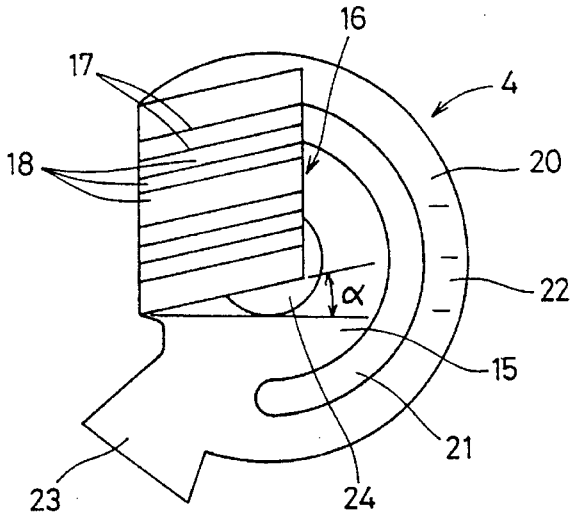
FIG. 5A is a plan view of a wiper provided in the variable resistor shown in FIG. 1.
Figure 5B:
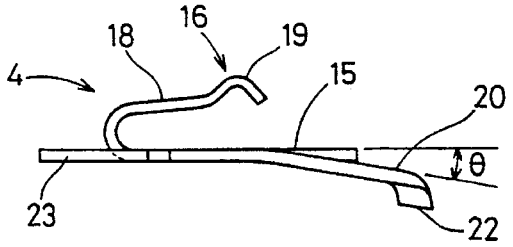
FIG. 5B is a front elevational view of the wiper shown in FIG. 5A.
Figure 5C:
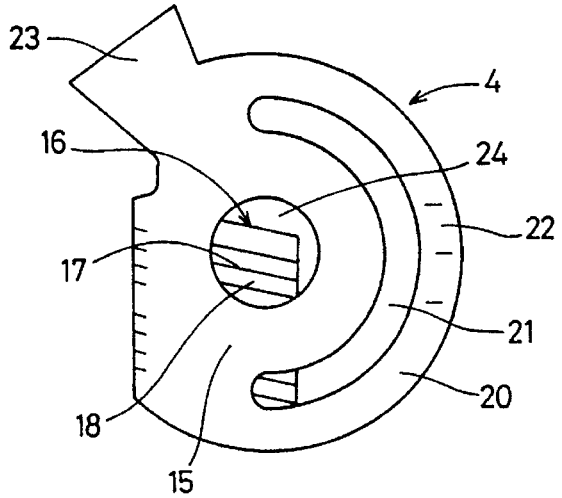
FIG. 5C is a bottom plan view of the wiper shown in FIG. 5A.

In the housing 2, the wiper 4 is arranged to be opposed to the major surface of the substrate 3 provided with the collector 6 and the resistive element 7, and held so that it rotates with respect to the substrate 3. As shown in FIGS. 5A, 5B and 5C, the wiper 4 is integrally formed by a metal plate with a spring-like character. The wiper 4 comprises a substantially circular wiper body 15 and a contact member The contact member 16 is formed by bending a portion extending integrally from the wiper body 15. A plurality of shearings 17 are preferably formed in the contact member 16, thereby dividing the contact member 16 into a plurality of fingers 18. The shearings 17 may be replaced by slits having prescribed widths.

The contact member 16 slides along the resistive element 7 (not shown) by rotation of the wiper 4, while attaining electrical contact between the aforementioned collector 6 and a selected position on the resistive element 7. A free end of the contact member 16 is positioned to radially extend along the wiper body 15, so that the contact member 16 comes into contact with both the collector 6 and the resistive element 7. Further, the contact member 16 is divided into the plurality of fingers 18 as described above, to provide a retinble electrical contact between the collector 6 and the resistive element 7.

When the contact member 16 is formed by bending, an angle $\alpha$ is provided with respect to the direction of bending as shown in FIG. 5A, so that the free end of the contact member 16 approaches the outer periphery of the wiper body 15 at the maximum. Thus, the radius of rotation of the contact member 16 can be further increased with no increase of the variable resistor 1 in size, making it possible to further increase the resistive element 7 in outer diameter providing an allowance for performance or characteristics such as rated power.

As clearly understood from FIG. 5B, further, the contact member 16 is preferably provided with a convex portion 19 in a portion which comes into contact with the collector 6 and the resistive element 7. This convex portion 19 further facilitates the reliable contact of the contact member 16 with the collector 6 and the resistive element 7.

The wiper 4 further comprises a detent member 20 for providing a clutch mechanism. The detent member 20 integrally extends from the wiper body 15 along its peripheral edge portion, while bridging two points of the peripheral edge portion. According to this embodiment, an arcuate slit 21 having a central angle of about 180° is provided along the peripheral edge portion of the wiper body 15, so that the detent member 20 is defined outside the slit 21. The detent member 20 is provided with an engaging portion 22 which is formed by a convex surface projecting toward a side opposite to the contact member 16. Further, the detent member 20 is preferably provided with an angle 8 with respect to the wiper body 15 as shown in FIG. 5B, so that the engaging portion 22 strongly elastically engages with the rotor 5.

The wiper 4 further comprises a stop arm 23 extending from the wiper body 15. In addition, the wiper 4 has a central through hole 24, which provides a rotation center.

In the housing 2, the rotor 5 is arranged to be opposed to the major surface of the substrate 3 through the wiper 4 and held to be rotatable with respect to the substrate 3 and the wiper 4. The rotor 5, which is in the form of a cylinder as a whole, is made of an electrically insulating material such as resin, for example.

Figure 6A:
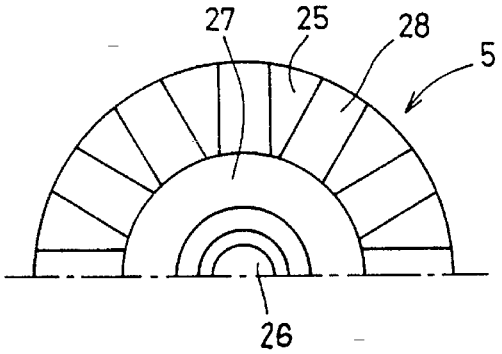
FIG. 6A is a plan view showing a half of a rotor provided in the variable resistor shown in FIG. 1.
Figure 6B:
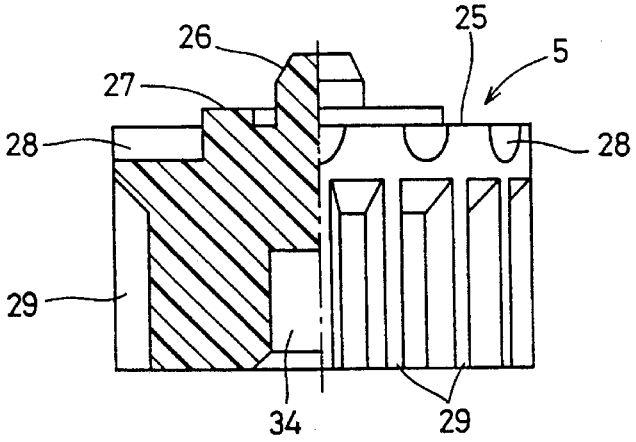
FIG. 6B is a partially sectioned front elevational view of the rotor shown in FIG. 6A.
Figure 6C:
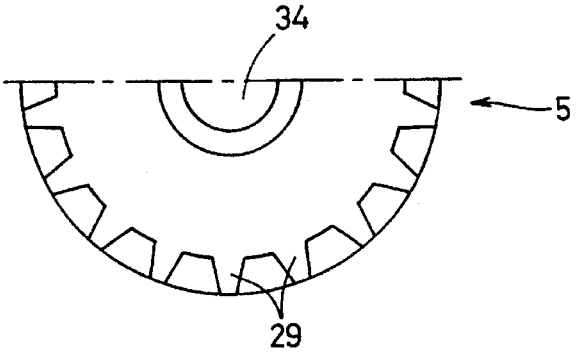
FIG. 6C is a bottom plan view of the half of the rotor shown in FIG. 6A.

FIGS. 6A, 6B and 6C independently show the rotor 5. A central post 26 is provided at the center of an upper end surface 25 of the rotor 5. Referring to FIG. 1, the central post 26 is received in the aforementioned central through hole 24 which is provided in the wiper 4, so that the rotor 5 is rotatable with respect to the wiper 4. When the central post 26 is received in the central through hole 24, the wiper body 15 is positioned on a boss 27 which projects with a step with respect to the upper end surface 25 (referring to FIG. 6B). Such a boss 27 may not be particularly provided.

The upper end surface 25 of the rotor 5 is provided with an engaging portion for elastically engaging with the engaging portion 22 of the detent member 20. According to this embodiment, the engaging portion formed in the rotor 5 is provided by a plurality of grooves 28 which are formed at regular intervals to radially extend on the upper end surface 25. Each of the grooves 28 has a U-shaped section, for example.

A plurality of gear teeth 29 are circumferentially arranged on an outer peripheral surface of the rotor 5. The gear teeth 29 are formed within a range not reaching the upper end surface 25, so that the same will not interfere with the grooves 28.

As shown by broken lines in FIG. 1, a worm 30 is provided to engage with the gear teeth 29, thereby rotating the rotor 5. The housing 2 is provided with a hole 31 (FIG. 3) extending inward from one side portion, and containing the worm 30 in it.

The worm 30 has a head portion 32 which is provided with a slot, so that a screwdriver or another tool (not shown) can be applied externally to the head portion 32 rotable the worm 30, and thereby also rotating the rotor 5.

As seen in FIG. 3, the rotor 5 is held in the housing 2 and rotables. the housing 2 is provided with a central hub 33, and the rotor 5 is provided on its lower end surface with a central cavity 34 for receiving the central hub 33.

After the rotor 5, the wiper 4 and the substrate 3 are inserted in the housing 2 in this order, a sealing member 35 of resin is applied to close an opening of the housing 2, as shown in FIGS. 2 and 3. Thus, the substrate 3 is fixed to the housing 2, and the wiper 4 and the rotor 5 are held in prescribed positions in the housing 2 by substrate 3.

In the variable resistor 1 assembled in the aforementioned manner, the contact member 16 provided in the wiper 4 attains electrical contact between the collector 6 and a selected portion of the resistive element 7. The worm 30 is driven to rotate in a desired direction, in order to adjust a resistance value provided by this variable resistor 1. The rotor 5 having the gear teeth 29 for engaging with the worm 30 is rotated in proportion to the rotation of the worm 30. The engaging portion 22 of the detent member 20 engages with any one of the grooves 28 which are provided in the rotor 5, whereby the wiper 4 is rotated along with the rotor 5. Due to such rotation of the wiper 4, the contact member 16 slides along the resistive element 7, whereby it is possible to adjust the resistance value provided by the variable resistor 1.

The range of rotation of the wiper 4 is so defined that the contact member 16 will nots slide beyond the range of extension of the resistive element 7. For this purposes the wiper 4 is provided with the stop arm 23, as hereinabove described. On the other hand, the housing 2 is provided with first and second stop walls 36 and 37, shown in FIG. 1, to be in contact with the stop arm 23 for defining the range of rotation of the wiper 4.

If the worm 30 is continuously rotated after the wiper 4 reaches a terminating end of the range of rotation, any portion of the worm 30, the rotor 5 or the wiper 4 may be damaged. The clutch mechanism is provided in order to prevent such damage. As hereinabove described, this clutch mechanism comprises the detent member 20 and the grooves 28. When the stop arm 23 comes into contact with the first or second stop wall 36 or 37 during rotation of the wiper 4, the wiper 4 is stopped with no further rotation. If the rotor 5 is still continuously rotated in this case, the engaging portion 22 of the detent member 20 disengages from the grooves 28 and engages with the next groove 28, then repeats this operation. Thus, the rotation of the rotor 5 is not transmitted to the wiper 4. As a result, the rotor 5 can be continuously rotated despite the stopped state of the wiper 4. When the direction of rotation of the rotor 5 is reversed, the engaging portion 22 of the detent member 20 again engages with any one of the grooves 28, so that the wiper 4 is again rotated along with the rotor 5.

Both end portions of the detent member 20 applying the aforementioned clutch action are connected with the wiper body 15. Therefore, the clutch action is applied so that it is highly reliable in relation to the operation of the wiper 4. further, in steps of assembling the variable resistor 1, it is possible to substantially prevent a reduction in efficiency of the assembly process by preventing the detent member 20 from being entangled with other components.

Although the engaging portion 22 provided on the detent member 20 is defined by a convex surface in the aforementioned embodiment, the engaging portion 22 may be replaced by a concave surface or a corrugated surface. Further, it is also possible to responsively change the shape of the second engaging portion, which is defined by the grooves 28 in the rotor 5.

What is claimed is:

1. A variable resistor comprising:

an electrically insulating substrate having at least one major surface on one side;

a conductive collector and a resistive element, which is arcuately extending around said collector, said collector and resistive element being formed on a major surface of said substrate;

an electrically conductive wiper having elasticity and arranged opposite to said at least one major surface of the substrate and rotatable with respect to said substrate;

said wiper including a curved wiper body and a contact member formed by a bent portion of the wiper integrally extending from said wiper body;

wherein the contact member bridges the collector and the resistive element and is able to slide along the resistive element due to the rotation of the wiper thereby creating an electrical contact between the collector and a selected position on the resistive element;

a rotor arranged opposite to said major surface of the substrate and being rotatable with respect to the substrate; and a clutch mechanism for transmitting rotation of the rotor to the wiper for rotating the wiper until the wiper is inhibited from further rotation, said clutch mechanism comprising a detent member integrally extending from said wiper body along its peripheral edge portion while bridging two points of said peripheral edge portion, said detent member and said rotor having respective first and second engaging portions which are elastically engageable with each other.

2. A variable resistor in accordance with claim 1, wherein said contact member comprises a plurality of fingers being divided from each other through a cut or shearing.

3. A variable resistor in accordance with claim 1, wherein said contact member is convex-shaped at a portion which mute said collector and said resistive element.

4. A variable resistor in accordance with claim 1, wherein the direction of bending for forming the contact member is selected so that a free end of said contact member approaches an outer periphery of the wiper body.

5. A variable resistor comprising:

an electrically insulating substrate having at least one major surface on one side;

a conductive collector and a resistive element, which is arcuately extending around said collector, said collector and resistive element being formed on a major surface of said substrate;

an electrically conductive wiper having elasticity and arranged opposite to said at least one major surface of the substrate and rotatable with respect to said substrate;

said wiper including a curved wiper body and a contact member formed by a bent portion of the wiper integrally extending from said wiper body;

wherein the contact member bridges the collector and the resistive element and is able to slide along the resistive element due to the rotation of the wiper thereby creating an electrical contact between the collector and a selected position on the resistive element;

a rotor arranged opposite to said major surface of the substrate and being rotatable with respect to the substrate; and a clutch mechanism for transmitting rotation of the rotor to the wiper for rotating the wiper until the wiper is inhibited from further rotation, said clutch mechanism comprising a detent member integrally extending from said wiper body along its peripheral edge portion while bridging two points of said peripheral edge portion, said detent member and said rotor having respective first and second engaging portions which are elastically engageable with each other;

wherein said detent member forms an angle (θ) with respect to said wiper body so that said first engaging portion strongly elastically engages with said second engaging portion.

6. A variable resistor in accordance with claim 1, wherein said wiper has a through hole in its center, said rotor comprising a central post to be received in said through hole.

7. A variable resistor in accordance with claim 1, further comprising a housing which firmly contains said substrate said housing being made of an eletrically insulting material.

8. A variable resistor in accordance with claim 7, wherein said housing comprises a central hub, said rotor having a central cavity for receiving said central hub.

9. A variable resistor in accordance with claim 7, further comprising a worm for rotating said rotor, said rotor comprising gear teeth being circumferentially arranged to engage with said worm, said housing having a hole for rotatably receiving said worm.

10. A variable resistor in accordance with claim 7, wherein said wiper comprises a stop arm extending from said wiper body, said housing comprising a stop wall to be in contact with said stop arm for defining the range of rotation of said wiper.

11. A variable resistor in accordance with claim 1, wherein said first engaging portion is provided by a convex surface being formed on said detent member, said second engaging portion being provided by a plurality of grooves being formed at regular intervals to radially extend on said rotor.

12. A variable resistor in accordance with claim 1, wherein the wiper body is made of metal.

13. A variable resistor in accordance with claim 1, wherein the detent member and contact member are integrally formed by a metal plate which makes up the wiper.

14. A variable resistor in accordance with claim 1, wherein said substrate holds a first, second and third terminal, said first and second terminals being electrically connected to end portions of the resistive element through at least one conductor film; and the third terminal being electrically connected to a conductor film which integrally extends from the collector.

15. A variable resistor in accordance with claim 14, wherein the first and third terminals extend flush with one end of the housing, whereby said variable resistor is surface mountable on a circuit board with said first and third terminals adhered to said circuit board.

16. A variable resistor in accordance with claim 14, wherein the third terminal is T-shaped and has a notch adjacent to a longitudinal center of a portion of the T-shaped terminal located in the substrate.

17. A variable resistor according to claim 2, whereas the fingers or shearing on the contact member are defined by slits having prescribed widths.

18. A variable resistor according to claim 1, wherein both ends of the detent member are coupled to the wiper body.

19. A variable resistor according to claim 1, wherein the contact member is formed by a bent portion of the wiper, creating an angle with respect to the direction of bending so that the free end of the contact member approaches the outer periphery of the wiper body.

* * * * *